US005123118A

United States Patent [19]

Shaw

[11] Patent Number: 5,123,118

[45] Date of Patent: Jun. 23, 1992

[54] CLIP-ON NECKTIE

[76] Inventor: Bob Shaw, 4512 Phillips La., Jonesboro, Ark. 72401

[21] Appl. No.: 833,054

[22] Filed: Feb. 10, 1992

[51] Int. Cl.[5] ..... A41D 25/04

[52] U.S. Cl. ..... 2/145; 2/146; 2/155; 2/156; 2/157; 24/50

[58] Field of Search ..... 2/137, 138, 139, 144, 2/145, 146, 147, 149, 155, 156, 157; 24/50

[56] References Cited

U.S. PATENT DOCUMENTS

| | | | |
|---|---|---|---|
| 914,416 | 3/1909 | Hulscher | 2/156 X |
| 922,089 | 5/1909 | Cowen | 2/145 |
| 1,088,890 | 3/1914 | Figg | 24/50 |
| 1,230,000 | 6/1917 | Marr et al. | 24/50 |
| 1,482,560 | 2/1924 | Hewes | 2/156 |
| 1,797,074 | 3/1931 | Clark | 2/156 X |
| 1,881,677 | 10/1932 | Klinetob | 24/50 |
| 2,501,741 | 3/1950 | Richman | 2/156 |
| 2,834,967 | 5/1958 | Taksa | 2/146 X |
| 3,942,191 | 3/1976 | Hunnicut | 2/145 |
| 4,777,665 | 10/1988 | Akamatsu | 2/156 X |
| 4,856,115 | 8/1989 | Knapp | 2/145 X |
| 5,003,636 | 4/1991 | Marostica | 2/156 X |

FOREIGN PATENT DOCUMENTS

| | | | |
|---|---|---|---|
| 374287 | 11/1920 | Fed. Rep. of Germany | 24/50 |
| 2240701 | 3/1975 | France | 2/145 |
| 2272229 | 3/1951 | Switzerland | 2/157 |
| 167253 | 8/1921 | United Kingdom | 24/50 |
| 261588 | 11/1926 | United Kingdom | 24/50 |
| 901528 | 7/1962 | United Kingdom | 24/50 |

*Primary Examiner*—Werner H. Schroeder
*Assistant Examiner*—Jeanette E. Chapman
*Attorney, Agent, or Firm*—Ray F. Cox, Jr.

[57] ABSTRACT

The present invention allows an ordinary necktie to be converted into usage as a clip-on necktie. A pair of flexible plastic fasteners are provided with a series of slots at one end of each fastener. The necktie is threaded through selected slots such that a span of necktie is formed between the ends of the fasteners. The tie is then tied in a normal fashion using any form of knot selected by the users. Once formed, the clip-on necktie may be assumed by placing the ends of the fasteners around the neck so that the fastening portions engage and interlock.

3 Claims, 2 Drawing Sheets

CLIP-ON NECKTIE

BACKGROUND OF THE INVENTION

This invention relates to a new and useful improvement in neckties, and, in particular, to the clip-on type of necktie in which the necktie may be worn by the simple action of clipping two ends of a neck band together without the necessity of untying and retying the necktie knot.

Numerous variations on the general concept of a clip-on necktie have been patented. However, the prior art in this area has been limited to the form of clip-on necktie in which the tie and, in particular, the knot, have been pre-formed by the manufacturer or those in which an ordinary necktie has been converted into a clip-on necktie by severing the neck band portion of the tie and providing the ends thereof with fastening devices.

Examples of this type of clip-on necktie includes U.S. Pat. No. 4,777,665 issued to Akamatsu on Oct. 18, 1988 for "Quick-Release Necktie." Akamatsu discloses a quick-release necktie comprising a preliminarily tied necktie base having a knot, neck bands extending both sides of the knot and a pair of quick release fasteners attached to the ends of the neck bands. Another example of a pre-formed necktie is U.S. Pat. No. 3,898,698 issued to Byrd, et al. on Aug. 12, 1975 for "Necktie."

Examples of an ordinary necktie whose neck band portion is severed and equipped with fasteners includes U.S. Pat. No. 3,942,191 issued to Hunnicutt on Mar. 9, 1976 for "Snap-On Necktie and Device for Converting Ordinary Four-in-Hand Necktie for Snap-On Usage" and U.S. Pat. No. 3,737,917 issued to Orr on Jun. 12, 1973 for "Adjustable Preformed Necktie."

Numerous other examples may be cited which address the problem of developing a suitable clip-on necktie in the fashion outlined above. However, none of the cited patents or any other prior art within the knowledge of the inventor allow an ordinary necktie to be used in a clip-on fashion without the necessity of severing or otherwise permanently modifying the necktie. Furthermore, the prior art in clip-on neckties normally involves a preformed or artificially manufactured knot rather than a naturally tied knot. Users are, therefore, normally limited to whatever form of knot the manufacturer has selected and are thereby prevented from selecting and using the form of knot that each individual might prefer. In addition, such preformed neckties limit or eliminate the possibility of retying or otherwise reforming the knot as circumstances might require.

Accordingly, the principal object of the present invention is the provision of a necktie which may be converted into clip-on usage without severing or otherwise permanently modifying the necktie so that the necktie may be returned to ordinary usage at the option of the user.

Another object of the present invention is to provide for a clip-on necktie which may be hand tied by the user, thereby preserving the user's options of selecting his preferred form of knot and of altering the knot as circumstances require.

It is a further object of the present invention to provide for a clip-on necktie which preserves the natural appearance of an ordinary hand-tied necktie.

It is also an object of the present invention to provide for a form of clip-on necktie which may be easily and securely fastened but which will separate under conditions of abnormal force being applied to the tie so that the clip-on necktie functions as a safety necktie.

Other objects and advantages of the present invention will be obvious to one skilled in the art as will appear from the following specification and claims in conjunction with the drawings.

SUMMARY OF THE INVENTION

The present invention allows an ordinary necktie to be converted into usage as a clip-on necktie. A pair of flexible plastic fasteners are provided with a series of slots at one end of each fastener. The series of slots allow the user to select the one which accommodates the user's neck size, method of knot tying and length of tie so that the finished clip-on necktie fits naturally about the neck and falls to the appropriate length. The ends of the fastener opposite to the slots provides for fastening means in the form of complementary angled slits and complementary offset regions which interlock. Although the fasteners are constructed of flexible plastic materials, the material is selected to have sufficient rigidity to resist becoming unfastened unless an abnormal amount of force is applied to the tie.

The fasteners are used in conjunction with an ordinary necktie in the following manner. The necktie is threaded through selected slots on the ends of the pair of fasteners such that a span of necktie is formed between the ends of the fasteners. The tie is then tied in the normal fashion using any form of knot selected by the user. The span of necktie formed between the two fasteners is simply tied within the knot as it is formed in the normal fashion.

Once formed, the clip-on necktie may be assumed by placing the ends of the fasteners around the neck so that the fastening portions engage and interlock. While being worn the clip-on tie may be loosened or retightened or even retied as would be true of an ordinary necktie. Furthermore, the necktie may be reconverted to ordinary usage simply by unfastening the knot and removing the tie from the pair of fasteners.

DESCRIPTION OF THE PREFERRED EMBODIMENT

Figure 2:
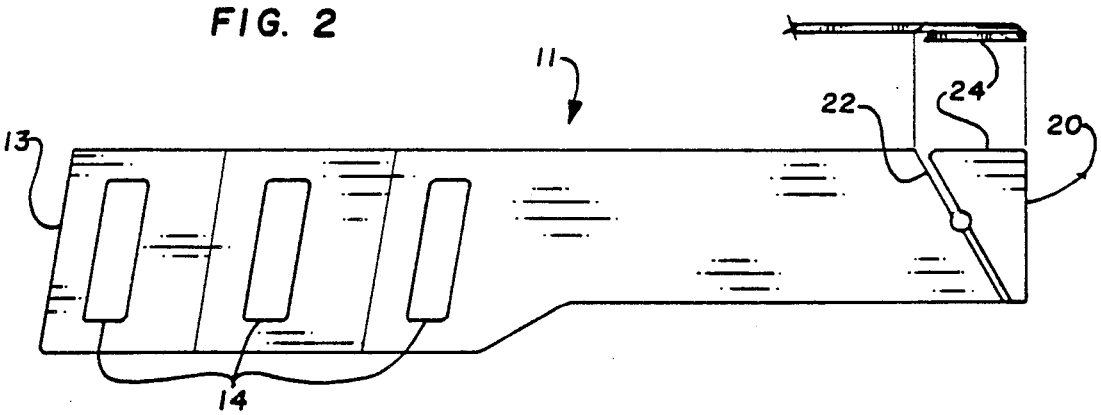
FIG. 2 is a plan view and partial top view of the right-hand fastener.
Figure 5:
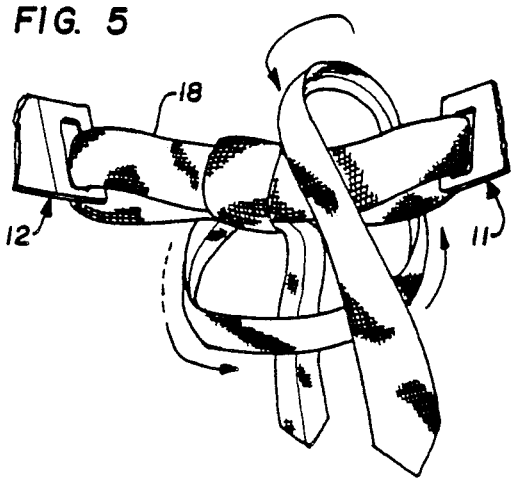
Figure 6:
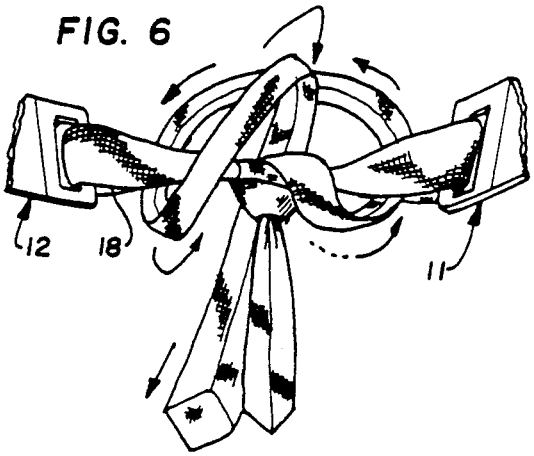
Figure 8:
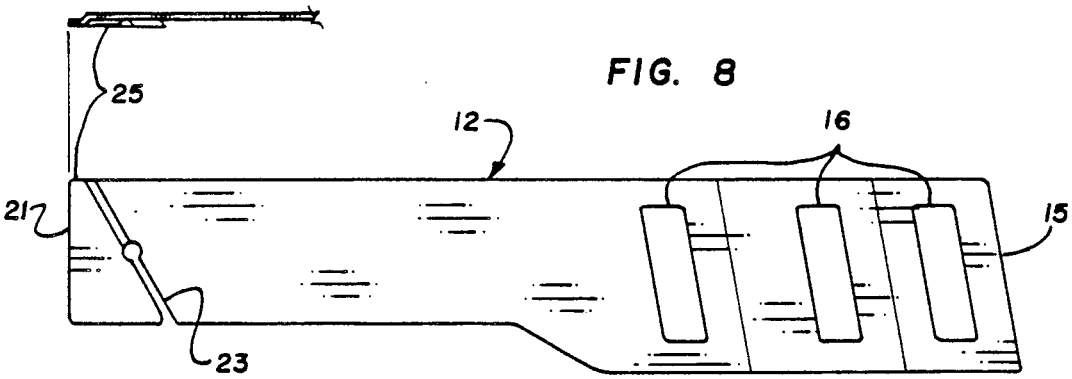
FIG. 8 is a plan view and partial top view of the left-hand fastener.

With reference to FIGS. 2 and 8 depicting the right hand and left hand fasteners 11 and 12 respectively, each fastener is constructed of a flexible plastic material which is sufficiently pliable to conform comfortably to the curvature of the human neck. The material is, however, rigid enough to resist any other deformation in normal usage. Both the right-hand fastener 11 and the left-hand fastener 12 are elongated strips approximately the width of a typical neck band of an ordinary necktie such that the fasteners can fit comfortably and invisibly under an ordinary shirt collar. With reference to FIG. 2, the anterior end 13 of the right-hand fastener 11 is provided with a plurality of slots 14. Likewise, with reference to FIG. 8 the anterior end 15 of the left-hand fastener 12 is provided with a plurality of slots 16. The slots 14 and 16 are spaced from the respective anterior ends 13 and 15 such that the user has the option of selecting a variety of positions with which to assemble the fasteners 11 and 12 to an ordinary necktie 17. Since each user will be individual in the size of his neck, the length and bulkiness of his preferred necktie, and his preferred style of knot, a degree of variation in the length of the fastener 11 and 12 is required to assure that each user will be able to tie the necktie 17 such that the assembled invention can clip comfortably about the user's neck and will assume the proper length in front. The user may, therefore, select the appropriate slots 14 and 16 and the superfluous slots may be severed from the fasteners 11 and 12 and discarded.

Figure 1:
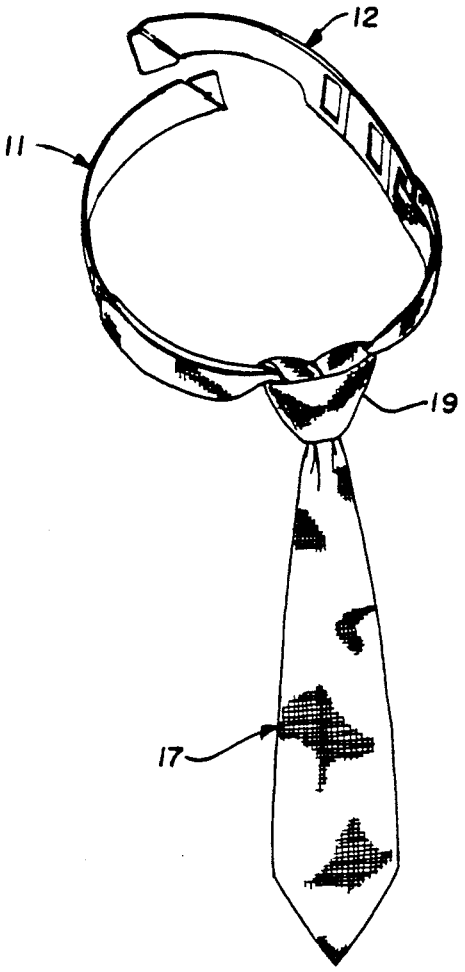
FIG. 1 is a perspective view of the present invention showing an ordinary necktie assembled with a pair of fasteners.
Figure 3:
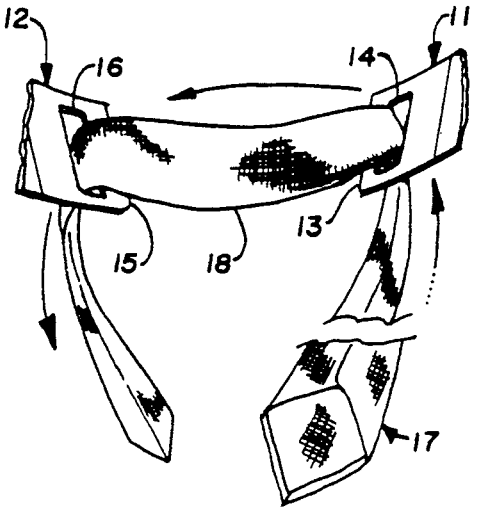
FIGS. 3 through 7 illustrate the sequence of assembling the necktie to the fasteners using a Windsor knot.
Figure 4:
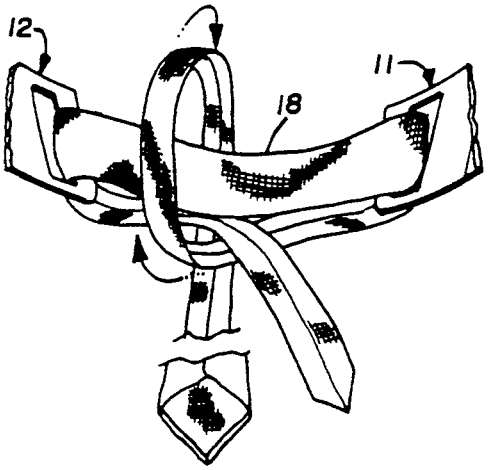

Referring to FIG. 1, the assembled invention comprising an ordinary necktie 17, the right-hand fastener 11 and the left-hand fastener 12 is shown. Assembling the ordinary necktie 17 to the fasteners 11 and 12 is shown with reference to FIGS. 3 through 7. FIGS. 3 through 7 illustrate the assembly of the present invention using a Windsor type of knot. However, this illustration is not intended to be limiting. The present invention is not limited to one style of knot but may be practiced with any standard form of necktie knot.

Figure 7:
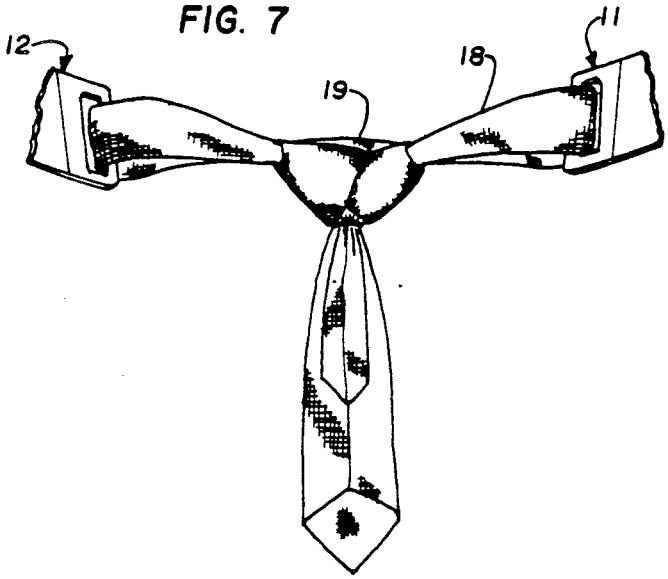

For ease of illustration, FIGS. 3 through 7 show the assembly of the present invention from the back side of the knot; that is to say, in the same orientation as the user would perceive. The selected necktie 17 is threaded through one of the slots 14 in the right-hand fastener 11 and thence through one of the slots 16 in the left-hand fastener 12. A span of necktie 18 is formed between the anterior ends 13 and 15 of the fasteners 11 and 12. From this point forward the knot is formed in precisely the same fashion as would be true of tying a necktie in the usual fashion. The only exception to the normal procedure is to ensure that the span of tie 18 is included within the knot as it is being formed. In other words, the span of necktie 18, which would pass in back of the neck if the tie were being tied in the ordinary fashion, passes in front of the neck and is incorporated within the finished knot 19. The finished knot 19 is shown in FIG. 7. The completely assembled invention is illustrated from the front in FIG. 1.

Once the knot 19 is formed it may be loosened and adjusted in the manner allowed by an ordinary necktie. As a clip-on necktie, however, the present invention need not be untied and retied on a regular basis. The present invention is worn by simply engaging fasteners 11 and 12 behind the neck of the user and it may be removed in an equally simple fashion. The fasteners 11 and 12 provide fastening means, which in the preferred embodiment, are illustrated in FIGS. 2 and 8.

The fasteners 11 and 12 have posterior ends 20 and 21 respectively. The posterior ends 20 and 21 are provided with angled slits 22 and 23. The angled slits 22 and 23 are arranged in complementary fashion such that the posterior ends 20 and 21 may interlock by sliding the posterior end 21 of the left-hand fastener 12 into the angled slit 22 of the right-hand fastener 11 and in complementary fashion the posterior end 20 of the right-hand fastener 11 slides into the angled slit 23 of the left-hand fastener 12. In order to ensure that the posterior ends 20 and 21 of the fasteners 11 and 12 lie flat after being interlocked, the present invention provides for offset regions 24 and 25 of the posterior ends 20 and 21 respectively. With reference to FIGS. 2 and 8, partial top views of the fasteners 11 and 12 illustrate the position of the offset regions 24 and 25. In use, the offset regions 24 and 25 lie inwardly, that is to say next to the neck of the user, such that the invention, when locked in place lies smooth and flat under the collar of the user without any unsightly bulging.

Also, in order for the present invention to fit comfortable and unobtrusively about the neck of the user, it is important that the fasteners 11 and 12 be maintained at a slight angle with respect to the necktie 17. Accordingly, as will be seen with reference to FIGS. 2 and 8, the slots 14 and 16 are disposed at an angle of approximately 80° relative to the horizontal or 10 ° relative to the anterior end. This angle provides the appropriate orientation of the fasteners 11 and 12 relative to the tie 17 so that the fasteners 11 and 12 lie in the appropriate position under the collar of the user.

The foregoing description of the preferred embodiment is intended to be illustrative and not by way of limitation to the scope of the invention as set forth in the appended claims. Modifications and variations that do not depart from the scope of the invention would be apparent to one skilled in the art.

What is claimed is:

1. A clip-on necktie, comprising:

a necktie;

a left-hand fastener; and a right-hand fastener;

said left-hand fastener and said right-hand fastener each having an anterior end and a posterior end;

said left-hand fastener and said right-hand fastener comprising straps of material having sufficient flexibility to comfortably conform to a curvature of a human neck and sufficient rigidity to resist any other deformation in normal usage;

said left-hand fastener and said right-hand fastener further comprising a plurality of slots arranged at various intervals from said anterior ends of said left-hand and right-hand fasteners, and fastening means disposed at said posterior ends of said left-hand and right-hand fasteners; and said necktie being assembled to said left-hand and right-hand fasteners by threading said necktie through one of said plurality of slots of said left-hand fastener and through one of said plurality slots of said right-hand fastener forming a span of necktie between said anterior ends of said left-hand and right-hand fasteners and tying said necktie forming any standard necktie knot such that said span of necktie is tied within said standard necktie knot.

2. A clip-on necktie as set forth in claim 1, wherein said fastening means comprises:

an angled slit near each of said posterior ends of said left-hand and right-hand fasteners and an offset region of each of said posterior ends of said left-hand and right-hand fasteners, wherein said angled slits and said offset regions are arranged in complementary fashion such that said posterior ends may interlock.

3. A clip-on necktie as set forth in claim 1, wherein said slots are disposed at an angle of approximately 10° relative the anterior ends.

* * * * *